United States Patent [19]

Morris-Sherwood et al.

[11] Patent Number: 4,548,726

[45] Date of Patent: Oct. 22, 1985

[54] WATER BASE HYDRAULIC FLUID

[75] Inventors: Betty J. Morris-Sherwood; Edward C. Brink, Jr., both of Port Arthur; David R. McCoy; Edward E. McEntire, both of Austin, all of Tex.

[73] Assignee: Texaco Inc., White Plains, N.Y.

[21] Appl. No.: 672,045

[22] Filed: Nov. 16, 1984

[51] Int. Cl.[4] ..... C09K 3/00; C10M 3/04; C10M 3/18; C10M 3/26

[52] U.S. Cl. ..... 252/75; 252/49.3; 252/76; 252/77; 252/78.5; 252/79; 252/356; 252/357

[58] Field of Search ..... 252/49.3, 75, 76, 77, 252/78.5, 79, 356, 357

[56] References Cited

U.S. PATENT DOCUMENTS 4,209,414 6/1980 Holgado et al. ..... 252/75
4,238,350 12/1980 Larsen et al. ..... 106/14.18
4,391,722 7/1983 Schwartz et al. ..... 252/75
4,470,918 9/1984 Mosier ..... 252/77

*Primary Examiner*—Paul Lieberman
*Assistant Examiner*—Robert A. Wax
*Attorney, Agent, or Firm*—Jack H. Park; Kenneth R. Priem; Richard A. Morgan

[57] ABSTRACT

A water base hydraulic fluid is disclosed. The fluid comprises 40 wt % of an amphoteric surfactant of the formula:

$$CH_3(CH_2)_5—CH(CH_3)—NHCH_2CH_2COOH$$

and 10 wt % polypropylene glycol in water.

The diluted hydraulic fluid is noted for its good wear characteristics, anticorrosiveness and non foaming nature.

10 Claims, No Drawings

WATER BASE HYDRAULIC FLUID

BACKGROUND OF THE INVENTION

This invention relates to a water base fluid, particularly to a water base hydraulic fluid which is noted for antiwear properties and noncorrosiveness.

DESCRIPTION OF THE PRIOR ART

Water-base hydraulic fluids are particularly valuable because of their fire resistant properties. They find use particularly in mining and other services such as aircraft, automotive, steel and lumber where fire is an exceptional concern.

Water-base hydraulic fluids have better coolant compatibility, better heat transfer properties, are less polluting and are non-oxidizing compared to conventional petroleum base hydraulic fluids. However, water-base fluids are typically deficient in extreme pressure and antiwear properties which limit their usefulness to applications where they are required. It is the object of this invention to provide a water based fluid with improved properties.

U.S. Pat. No. 4,238,350 describes a corrosion inhibiting liquid.

SUMMARY OF THE INVENTION

The present invention comprises a water base fluid comprising a major amount of an amphoteric surfactant and a minor amount of polypropylene glycol. The amphoteric surfactant in an amount of 35 to 45 wt % is of the formula:

$$CH_3(CH_2)_5—CH(CH_3)—NHCH_2CH_2COOH$$

The polypropylene glycol is of molecular weight 200 to 600.

DESCRIPTION OF THE PREFERRED EMBODIMENTS

The present invention is a water base fluid composition comprising:

(a) 35 to 45 wt % of an amphoteric surfactant of the formula:

$$CH_3(CH_2)_5—\overset{\overset{\displaystyle CH_3}{|}}{CH}—NHCH_2CH_2COOH$$

(b) 5 to 15 wt %; preferably 8 to 12 wt %, of polypropylene glycol of molecular weight 200 to 600; and (c) water.

The composition may additionally comprise rust inhibitor, aluminum corrosion inhibitor, copper corrosion inhibitor or mixtures thereof.

Laboratory tests have shown that the compositions of the present invention after dilution with water provide good rust protection and antiwear properties with superior foam inhibition. This is unexpectedly achieved without steel staining or etching. These compositions do not settle and they demonstrate good freeze thaw characteristics.

In this regard, the present invention is a concentrated hydraulic fluid comprising:

(a) 35 to 45 wt % of an amphoteric surfactant of the formula:

$$CH_3(CH_2)_5—\overset{\overset{\displaystyle CH_3}{|}}{CH}—NHCH_2CH_2COOH$$

(b) 8 to 12 wt % polypropylene glycol of molecular weight 200 to 600;

(c) triethanolamine, diethanolamine and modified phosphate ester in an amount sufficient to inhibit rust;

(d) phosphoric acid in an amount sufficient to inhibit aluminum corrosion;

(e) benzotriazole in an amount sufficient to inhibit copper corrosion; and (f) water.

The composition is prepared by stirring the constituents in a stainless steel kettle at 100° F. The blends are then diluted with the desired amount of water to make the concentrate.

These fluids are shipped as concentrates. Before use they are diluted with water, typically 2 wt % to 10 wt % concentrate in water. Standard dilutions are 2 wt %, 5 wt % and 10 wt % concentrate in water, with 5% being the industry standard.

This invention is better shown by way of example.

EXAMPLE 1A

One of the corrosion tests passed by the composition of the present invention was a Modified ASTM D 665 Rust Test. In this modified test a cylindrical steel specimen was polished by successive grinding with 150 to 240 grit aluminum oxide abrasive cloth. The steel specimen was inserted in a rubber stopper equipped with a hole. Sufficient quantity of the fluid composition to be tested was charged to a flask such that when the specimen was in place in the flask, approximately one-half of the specimen was immersed. The flask, test solution and specimen were placed in an oil bath maintained at a temperature of about 140° F. (55.5° C.). The portion of the steel specimen subjected to vapor and the portion subjected to the liquid portion of the fluid were rated after the first hour for evidence of rusting and again after completion of the first 24 hour test period. The rating system used was similar to that defined by MIL-L-24467. This rating system defined no rust as being no rust visible on the specimen, trace rust as being 1–6 rust specks of no more than 1 millimeter in diameter, light rust as being 7–12 rust specks, moderate rust was an overall light rust, and heavy rust was an overall heavy rust or heavy rust spots.

The composition of the present invention was tested for foaming according to Test Method ASTM D 892 Sequences I, II and III. In the Sequence I Test approximately 200 milliliters of samples were decanted into a beaker and were heated to about 49° C. and then allowed to cool to about 24° C. The cooled sample was then poured into a 1000 milliliter cylinder until the liquid level was at the 190 milliliter mark. The cylinder was then immersed to at least the 900 milliliter mark in a bath maintained at about 24° C. A diffuser stone and air inlet tube were then inserted into the cylinder and into the sample. About 94 milliliters of air per minute were forced through the stone for about 5 minutes. At the end of the period the air flow was shut off and the total volume of foam was measured and then measured again after ten minutes of waiting.

In the Sequence II Test, a second portion of sample was poured into a 1000 milliliter cylinder until the liquid level was at the 180 milliliter mark. The cylinder was immersed into a bath maintained at a temperature of about 93.5° C. A diffuser stone was then immersed into the sample in the cylinder and the test was carried out as in the Sequence I Test.

In the Sequence III Test, any foam remaining after the Sequence II Test was collapsed, the sample was then allowed to cool to a temperature below about 43.5° C. and then further cooled to a temperaure of about 24° C. A gas diffuser stone was inserted and the test was then carried out as in Sequence I and II. The composition of the present invention produced low or no foaming in all sequences. Low foaming is an important characteristics of hydraulic fluids.

The Load Wear Index (LWI) refers to the load carrying property of a fluid. It is the index of the ability of a fluid to prevent wear at applied loads. Under the conditions of the test, specific loadings in kilograms having intervals of 0.1 logarithmic units are applied to three stationary balls for ten runs prior to welding. The test procedure is described in ASTM D 2596. The Four Ball Wear Test determines wear preventive characteristics in sliding steel-on-steel applications carried out as described in ASTM D 2266.

In the Chip Rust Test, approximately 15 ml of clean, dry cast-iron chips are soaked in the test fluid. The fluid is drained and the chips are then spread evenly over the bottom of a 100 mm diameter Petri dish. After drying for 16 hours, the chips are then rated for rust. The rusting of 11 or more chips constitutes a "fail".

In the Plate Rust Test, a clean, cast-iron plate 10 $\frac{3}{4}'' \times 8\frac{1}{2}'' \times \frac{1}{2}''$ cross-hatched into 252 equal squares is polished by rubbing under oil with No. 150 grade emery cloth. After the plate has a mirror finish, the oil is wiped off with tissue paper and washed free of oil with acetone. One drop of the test fluid is placed onto a square. One drop of a standard fluid (for high water base fluids a competitive product was used) is placed on the square beneath the test fluid. After standing for 24 hours, the plate is examined for any sign of corrosion, pitting, etching, or pink, red or brown discoloration. If any of the above are observed, the test fluids fails this test.

In the Modified ASTM D 2882 Pump Test, five gallons of the test hydraulic fluid is circulated through a rotary vane pump rig for 100 hours derated to 500 psi, 1200 RPM and room temperature. At the conclusion of the test, the weigt loss on the cam ring and vanes of the pump rig are observed. The pump cartridge is observed for signs of wear, deposit formation and discoloration. The test fluid is observed for discoloration or unusual odor. Compositions A and B were compounded according to the procedure described herein.

MA-200 is the amphoteric surfactant of the formula:

$$CH_3(CH_2)_5-\underset{}{\overset{CH_3}{\overset{|}{CH}}}-NHCH_2CH_2COOH$$

| EXAMPLE 1A | A | B |
|---|---|---|
| Concentrate Composition, wt % | | |
| MA-200 | 40.0 | 20.0 |
| Deionized Water | 29.0 | 49.0 |
| JEFFOX ® PPG-400 (Polypropylene glycol, MW 400) | 10.0 | 10.0 |
| Triethanolamine | 10.0 | 10.0 |
| Diethanolamine | 5.0 | 5.0 |
| UNIHIB ® 2000 (modified phosphate ester) | 4.0 | 4.0 |
| Phosphoric Acid, 85% | 1.0 | 1.0 |
| Benzotriazole | 1.0 | 1.0 |
| Blue Dye (ppm) | (50 ppm) | (50 ppm) |
| Tests - Concentrated | | |
| Appearance | Clear Blue | — |
| Specific Gravity 60/60° F. | 1.0536 | — |
| Viscosity, cst, 40° C. | 18.40ck18.58 | — |
| 65.6° C. | 7.83ck7.84 | — |
| Pour °F. | -20ck-20 | — |
| Freeze-Thaw Cycle, 5 days | No Change | — |
| Oven Stability, 150° F. | Amber | — |

| | Competitive Product 1 | Competitive Product 2 | Competitive Product 3 |
|---|---|---|---|
| Tests - Concentrate | | | |
| Appearance | Blue, Separated | Yellow | Blue, Separated |
| Specific Gravity 60/60° F. | 1.0414ck1.0223* | — | 1.0614 |
| Viscosity, cSt, 40° C. | 25.7 | — | 451.9 |
| 65.6° C. | — | — | 160.0 |
| Pour °F. | — | — | 10 |
| Oven Stability | Separated, 1 cycle | — | Separated, 4 Cycles |

| EXAMPLE 1B | A | B |
|---|---|---|
| Diluted Concentrate | | |
| Wt % in water | 5 | 5 |
| Tests - Diluted | | |
| Appearance | Cloudy Blue | Cloudy Blue |
| Viscosity, cSt, 40° C. | 0.77ck0.73 | 0.81 |
| 65.6° C. | 0.52ck0.51 | 0.52 |
| Pour, °F. | 30 | 30 |

-continued

| Foam (ASTM D 892) SEQ | I | II | III | I | II | III |
|---|---|---|---|---|---|---|
| Immed. after Blowing, ml. | 30 | 10 | 300 | 10 | 0 | 30 |
| After 10 min. settling, ml. | 10 | 0 | 30 | 0 | 0 | 20 |
| pH | | 7.9ck8.5 | | | 8.8 | |
| Chip Rust | | Pass | | | — | |
| Plate Rust | | FailckPass | | | — | |
| Modified (ASTM D 665A) | | | | | | |
| Vapor Phase | | Lt.RustckPass | | | Mod. Rust | |
| Liquid Phase | | PassckPass | | | Pass | |
| Modified ASTM D 2882 Pump Test 100 Hr., RT., 500 PSI 1200 RPM | | | | | | |
| Wt Loss, Gram/100 Hr. | | — | | | 2.2147 | |

| | EXAMPLE 2A | |
|---|---|---|
| | D | E |
| Concentrate Composition, wt % | | |
| Deionized Water | 31.0 | 29.0 |
| MA-200 | 40.0 | 40.0 |
| JEFFOX ® PPG-400 | 10.0 | 10.0 |
| Triethanolamine | 10.0 | 10.0 |
| Diethanolamine | 4.0 | 5.0 |
| UNIHIB ® 2000 | 4.0 | 4.0 |
| Phosphoric Acid | — | 1.0 |
| Benzotriazole | 1.0 | 1.0 |
| Blue Dye (ppm Added) | — | (150) |
| | 100.0 | 100.0 |
| Tests - Concentrate | | |
| Specific Gravity 60/60° F. | — | 1.0503 |
| Viscosity, cst, 40° C. | — | 19.57 |
| 65.6° C. | — | 8.29 |
| Pour, °F. | — | −10 |

| | EXAMPLE 2B | |
|---|---|---|
| | D | E |
| Diluted Fluid, Wt % in Water | 5 | 5 |
| Tests - Diluted | | |
| Viscosity, cSt, 40° C. | 0.83 | 0.75 |
| 65.6° C. | 0.53 | 0.50 |
| Pour °F. | — | — |

| Foam (ASTM D 892) SEQ | I | II | III | I | II | III |
|---|---|---|---|---|---|---|
| Immed. after Blowing, ml. | 10 | 10 | 10 | 10 | 0 | 50 |
| After 10 min. settling, ml. | 0 | 0 | 0 | 0 | 0 | 0 |
| pH | | 8.9 | | | 8.6 | |
| Chip Rust | | Pass | | | Pass | |
| Plate Rust | | Pass | | | Pass | |
| Mod ASTM D 665A Rust Test | | | | | | |
| Vapor Phase | | FailckPass | | | Pass | |
| Liquid Phase | | FailckPass | | | Pass | |
| Four Ball Wear 1 Hr. 600 RPM, RT 1/10/40 Kg mm scar dia | | —/0.66/0.78 | | | — | |
| LWI (Weld Pt), Kg. | | 25(126) | | | — | |

| | Competitive Product 1 | Competitive Product 2 | Competitive Product 3 |
|---|---|---|---|
| Diluted Concentrate | | | |
| Wt % in water | 5 | 5 | 5 |
| Tests - Diluted Fluid | | | |
| Appearance | Cloudy Blue | Cloudy Yellow | Cloudy Blue |
| Viscosity, cSt, 40° C. | 0.81 | 1.18 | 26.48 |
| 65.6° C. | — | — | 5.36 |
| Pour, °F. | — | — | 30 |

| Foam (ASTM D 892) SEQ | I | II | III | I | II | III | I | II | III |
|---|---|---|---|---|---|---|---|---|---|
| Immed. after Blowing, ml. | 450 | 20 | 340 | 200 | 260 | 270 | 420 | 940 | 430 |
| After 10 min. settling, ml. | 40 | 0 | 50 | 60 | 6 | 100 | 420 | 540 | 430 |
| pH | | 10.3ck9.9 | | | 9.2 | | | 9.7 | |
| Chip Rust | | Pass | | | Pass | | | Fail | |
| Plate Rust | | Pass | | | Pass | | | Fail | |
| Modified (ASTM D 665A) Rust Test | | | | | | | | | |
| Vapor Phase | | Lt.RustckPass | | | Pass | | | Mod. Rust | |
| Liquid Phase | | PassckPass | | | Pass | | | Pass | |
| Load Wear Index (LWI) | | 23 | | | 37 | | | 26 | |
| Weld Pt, Kg | | 100 | | | 126 | | | 126 | |
| Four Ball Wear, mm scar dia 1 Hr., 600 RPM, RT | | .52/0.67/0.62 | | | 0.46/0.53/0.60 | | | 0.52/0.62/0.76 | |

-continued

| | | | |
|---|---|---|---|
| 1/10/40 Kg load Modified ASTM D 2882 Pump Test 100 Hr., RT., 500 psi 1200 RPM Total Wt Loss, Gram/100 Hr. | 2.003 | 1.622ck2.006 | — |

*Variable results probably due to product separation
Product 1 — Houghton Hydrolubric 120B
Product 2 — Lubrizol OS-49084
Product 3 — BASF Wyandott Plurasafe P-1200

Products 1, 2 and 3 are the same as those of Example 1A.

The principle of the invention and the best mode contemplated for applying that principle have been described. It is to be understood that the foregoing is illustrative only and that other means and techniques can be employed without departing from the true scope of the invention defined in the following claims.

What is claimed is:

1. A water base fluid composition comprising:

(a) 35 to 45 wt % of an amphoteric surfactant of the formula:

$$CH_3(CH_2)_5-\overset{\overset{\displaystyle CH_3}{|}}{C}H-NHCH_2CH_2COOH$$

(b) a minor amount of polypropylene glycol of molecular weight 200 to 600; and (c) water.

2. A water base fluid composition comprising:

(a) 35 to 45 wt % of an amphoteric surfactant of the formula:

$$CH_3(CH_2)_5-\overset{\overset{\displaystyle CH_3}{|}}{C}H-NHCH_2CH_2COOH$$

(b) 5 to 15 wt % polypropylene glycol of molecular weight 200 to 600; and (c) water.

3. The composition of claim 2 wherein the polypropylene glycol is in an amount of 8 to 12 wt %.

4. The composition of claim 2 which additionally comprises rust inhibitor.

5. The composition of claim 2 which additionally comprises aluminum corrosion inhibitor.

6. The composition of claim 2 which additionally comprises copper corrosion inhibitor.

7. The composition of claim 2 which is diluted with water to comprise 2 wt % to 10 wt % of an aqueous fluid.

8. A concentrated hydraulic fluid comprising:

(a) 35 to 45 wt % of an amphoteric surfactant of the formula:

$$CH_3(CH_2)_5-\overset{\overset{\displaystyle CH_3}{|}}{C}H-NHCH_2CH_2COOH$$

(b) 8 to 12 wt % polypropylene glycol of molecular weight 200 to 600;

(c) triethanolamine, diethanolamine and modified phosphate ester in an amount sufficient to inhibit rust;

(d) phosphoric acid in an amount sufficient to inhibit aluminum corrosion;

(e) benzotriazole in an amount sufficient to inhibit copper corrosion; and (f) water.

9. The hydraulic fluid of claim 8 which is diluted with water to comprise 2 wt % to 10 wt % of an aqueous fluid.

10. A hydraulic fluid comprising:

(a) 40 wt % of an amphoteric surfactant of the formula:

$$CH_3(CH_2)_5-\overset{\overset{\displaystyle CH_3}{|}}{C}H-NHCH_2CH_2COOH;$$

(b) 10 wt % polypropylene glycol of molecular weight 400;

(c) 10 wt % triethanolamine;

(d) 5 wt % diethanolamine;

(e) 4 wt % modified phosphate ester;

(f) 1 wt %, 85% phosphoric acid;

(g) 1 wt % benzotriazole; and (h) water

* * * * *